US010077723B1

(12) United States Patent
Koo et al.

(10) Patent No.: US 10,077,723 B1
(45) Date of Patent: Sep. 18, 2018

(54) APPARATUS AND METHOD FOR COMPENSATING FOR FUEL INJECTION QUANTITY IN ENGINE OF VEHICLE

(71) Applicants: HYUNDAI MOTOR COMPANY, Seoul (KR); KIA MOTORS CORPORATION, Seoul (KR)

(72) Inventors: Bon Chang Koo, Seongnam-si (KR); Jung Hwan Han, Ansan-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/670,676

(22) Filed: Aug. 7, 2017

(30) Foreign Application Priority Data

Mar. 14, 2017 (KR) ..... 10-2017-0031860

(51) Int. Cl.

| | |
|---|---|
| ***F02D 35/00*** | (2006.01) |
| *F02D 41/02* | (2006.01) |
| *F02D 41/04* | (2006.01) |
| *F02D 41/14* | (2006.01) |

(52) U.S. Cl.
CPC ..... *F02D 35/0092* (2013.01); *F02D 41/0205* (2013.01); *F02D 41/04* (2013.01); *F02D 2041/1432* (2013.01)

(58) Field of Classification Search
CPC .. F02D 35/00; F02D 35/0092; F02D 41/0205; F02D 41/04; F02D 2041/1432
See application file for complete search history.

(56) References Cited

U.S. PATENT DOCUMENTS 4,870,938 A * 10/1989 Nakaniwa ..... F02D 41/1475 123/674
6,701,906 B2 * 3/2004 Kim ..... F02D 41/0042 123/488

FOREIGN PATENT DOCUMENTS

JP 59224436 A * 12/1984 ..... F02D 41/1441
KR 10-0527702 B 11/2005

* cited by examiner

*Primary Examiner* — Hieu T Vo
(74) *Attorney, Agent, or Firm* — Brinks Gilson & Lione

(57) ABSTRACT

Provided are an apparatus and a method for compensating for a fuel injection quantity in an engine of a vehicle. The apparatus for compensating for a fuel injection quantity may include: an information collector collecting status information of the vehicle; an oxygen sensor outputting a voltage corresponding to a concentration of oxygen in exhaust gases; a high pass filter (HPF) filtering the output voltage of the oxygen sensor; and a controller generating a reference value on the basis of the status information of the vehicle. In particular, the controller calculates an offset using the reference value and a signal obtained by high-pass filtering the output voltage, and compensates for a fuel injection quantity in each individual cylinder of the engine of the vehicle on the basis of the offset.

20 Claims, 5 Drawing Sheets

APPARATUS AND METHOD FOR COMPENSATING FOR FUEL INJECTION QUANTITY IN ENGINE OF VEHICLE

CROSS-REFERENCE TO RELATED APPLICATION

This application claims priority to and the benefit of Korean Patent Application No. 10-2017-0031860, filed Mar. 14, 2017, which is incorporated herein by reference in its entirety.

FIELD

The present disclosure relates to an apparatus and a method for compensating for a fuel injection quantity in an engine of a vehicle.

BACKGROUND

The statements in this section merely provide background information related to the present disclosure and may not constitute prior art.

In general, an oxygen sensor is mounted in an exhaust manifold of a vehicle and measures the concentration of oxygen in exhaust gases, and the oxygen sensor may use zirconia generating electromotive force when oxygen quantity on both zirconia surfaces of the oxygen sensor becomes different. That is, the oxygen sensor may use a principle of measuring the concentration of oxygen according to the degree of electromotive force generated by zirconia positioned between the exhaust gas and air in the atmosphere.

For example, when an air-fuel ratio in the exhaust gas is rich (i.e., fuel is rich and oxygen is lean), the concentration of oxygen in the exhaust gas is lower than the concentration of oxygen in the atmosphere and thus electromotive force is generated by the oxygen sensor. By contrast, when the air-fuel ratio in the exhaust gas is lean (namely, fuel is lean and oxygen is rich), the concentration of oxygen in the exhaust gas does not differ from the concentration of oxygen in the atmosphere and thus electromotive force is not generated by the oxygen sensor.

Fuel injection control techniques according to the related art adjust an air-fuel ratio (a ratio between the quantity of air and the quantity of fuel) of a mixture injected into a cylinder in an engine of a vehicle on the basis of the concentration of oxygen in exhaust gases. However, we have discovered that the fuel injection control technologies do not consider a torque deviation between individual cylinders of the engine, and thus it causes cylinder imbalance.

As a result, the fuel efficiency of the vehicle may be reduced and the quantity of exhaust gases may be increased. In addition, the durability of the engine may be undermined.

SUMMARY

The present disclosure addresses the above-mentioned problems occurring in the prior art while advantages achieved by the prior art are maintained intact.

An aspect of the present disclosure provides an apparatus and a method for compensating for a fuel injection quantity in an engine of a vehicle, which are able to reduce a torque deviation between individual cylinders of the engine by measuring an output voltage of an oxygen sensor mounted in an exhaust manifold of the vehicle during an exhaust stroke of each individual cylinder. The present disclosure provides compensation for a fuel injection quantity in each individual cylinder of the engine based on a result obtained by high-pass filtering the measured output voltage.

The objects of the present disclosure are not limited to the foregoing objects, and any other objects and advantages not mentioned herein will be clearly understood from the following description. The present inventive concept will be more clearly understood from exemplary forms of the present disclosure. In addition, it will be apparent that the objects and advantages of the present disclosure can be achieved by elements and features claimed in the claims and a combination thereof.

According to an aspect of the present disclosure, an apparatus for compensating for a fuel injection quantity in an engine of a vehicle includes: an information collector configured to collect status information of the vehicle; an oxygen sensor configured to output a voltage corresponding to a concentration of oxygen in exhaust gases; a high pass filter (HPF) configured to filter the output voltage of the oxygen sensor; and a controller configured to generate a reference value on the basis of the status information of the vehicle, obtain an offset using the reference value and a signal obtained by high-pass filtering the output voltage, and to compensate for a fuel injection quantity in each individual cylinder of the engine of the vehicle on the basis of the offset.

The reference value corresponds to the output of the engine, the RPM of the engine, or the speed of the vehicle collected by the information collector. The controller divides the signal of the high-pass filtered output voltage into a plus region and a minus region on the basis of the reference value, and the fuel injection quantity in each individual cylinder of the engine is compensated based on intensities of a signal detected in at least one of the plus region or the minus region.

The controller may add an intensity of a signal at a current point in time and an intensity of a signal at a previous point in time in the plus region, calculate a first representative value in the plus region. The controller also adds an intensity of the signal at the current point in time and an intensity of the signal at the previous point in time in the minus region and calculates a second representative value in the minus region, adds the first representative value and the second representative value, and calculates the offset to compensate for the fuel injection quantity.

The controller may multiply a reference fuel injection quantity by the calculated offset to calculate a compensating fuel injection quantity.

The controller may add the compensating fuel injection quantity to the reference fuel injection quantity to calculate a final fuel injection quantity.

The function of the controller may be implemented by an engine control unit.

The information collector may collect the output and RPM of the engine, and a speed of the vehicle through a vehicle network. The vehicle network may include at least one of Controller Area Network (CAN), Local Interconnect Network (LIN), FlexRay, and Media Oriented Systems Transport (MOST).

According to another aspect of the present disclosure, a method for compensating for a fuel injection quantity in an engine of a vehicle includes the steps of: collecting, by an information collector, status information of the vehicle; outputting, by an oxygen sensor, a voltage corresponding to a concentration of oxygen in exhaust gases; filtering, by a high pass filter (HPF), the output voltage of the oxygen sensor; and generating, by a controller, a reference value on the basis of the status information of the vehicle, obtaining an offset using the reference value and a signal of the high-pass filtered output voltage, and compensating for a fuel injection quantity in each individual cylinder of the engine of the vehicle on the basis of the offset.

The step of compensating for the fuel injection quantity may include: generating the reference value corresponding to the output of the engine, the RPM of the engine, or the speed of the vehicle; dividing the signal of the high-pass filtered output voltage into a plus region and a minus region on the basis of the reference value; adding an intensity of a signal at a current point in time and an intensity of a signal at a previous point in time in the plus region to calculate a first representative value in the plus region; adding an intensity of the signal at the current point in time and an intensity of the signal at the previous point in time in the minus region to calculate a second representative value in the minus region; and adding the first representative value and the second representative value to calculate the offset for compensating for the fuel injection quantity.

The method may further include multiplying a reference fuel injection quantity by the calculated offset to calculate a compensating fuel injection quantity.

The method may further include adding the compensating fuel injection quantity to the reference fuel injection quantity to calculate a final fuel injection quantity.

According to another aspect of the present disclosure, a method for compensating for a fuel injection quantity in an engine of a vehicle includes the steps of: storing, by a storage, a table including reference values corresponding to output of the engine, RPM of the engine, and a speed of the vehicle are recorded; collecting, by an information collector, information of the output of the engine, the RPM of the engine, and the speed of the vehicle; outputting, by an oxygen sensor, a voltage corresponding to a concentration of oxygen in exhaust gases; filtering, by a high pass filter (HPF), the output voltage of the oxygen sensor; and detecting, by a controller, a reference value corresponding to the collected information of at least of the output of the engine, the RPM of the engine, and the speed of the vehicle from the table, obtaining an offset using the reference value and a signal of the high-pass filtered output voltage, and compensating for a fuel injection quantity in each individual cylinder of the engine on the basis of the offset.

The step of compensating for a fuel injection quantity may include: detecting the reference value corresponding to the collected information of the output and RPM of the engine and the speed of the vehicle from the table; dividing a signal of the high-pass filtered output voltage into a plus region and a minus region on the basis of the reference value; adding an intensity of a signal at a current point in time and an intensity of a signal at a previous point in time in the plus region to calculate a first representative value in the plus region; adding an intensity of the signal at the current point in time and an intensity of the signal at the previous point in time in the minus region to calculate a second representative value in the minus region; and adding the first representative value and the second representative value to calculate the offset to compensating for the fuel injection quantity.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
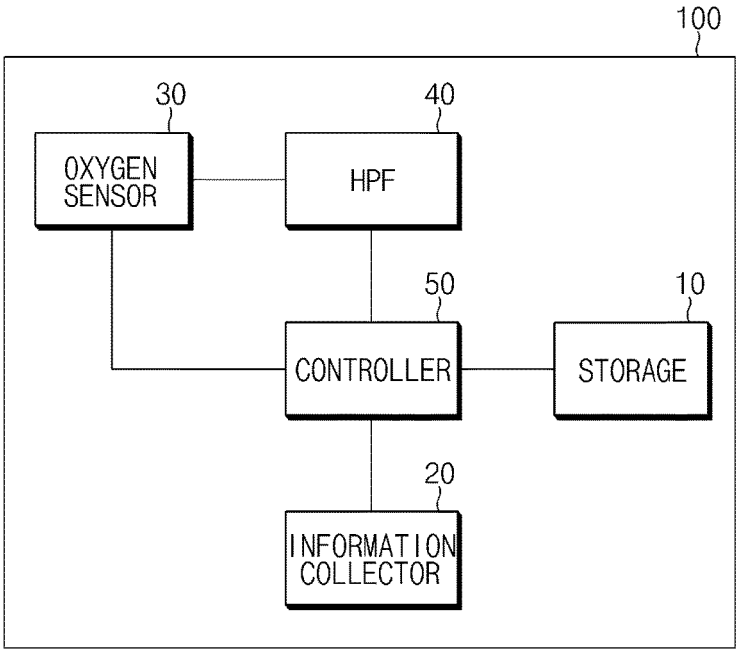
FIG. 1 illustrates a block diagram of the configuration of an apparatus for compensating for a fuel injection quantity using an oxygen sensor, according to an exemplary form of the present disclosure.

The drawings described herein are for illustration purposes only and are not intended to limit the scope of the present disclosure in any way.

DETAILED DESCRIPTION

Hereinafter, exemplary forms of the present disclosure will be described in detail with reference to the accompanying drawings. In the drawings, the same reference numerals will be used throughout to designate the same or equivalent elements. In addition, a detailed description of well-known techniques associated with the present disclosure will be ruled out in order not to unnecessarily obscure the gist of the present disclosure.

The following description is merely exemplary in nature and is not intended to limit the present disclosure, application, or uses.

Terms such as first, second, (A), (B), (a), and (b) may be used to describe the elements in exemplary forms of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

FIG. 1 illustrates a block diagram of the configuration of an apparatus for compensating for a fuel injection quantity using an oxygen sensor, according to an exemplary form of the present disclosure.

As illustrated in FIG. 1, an apparatus 100 for compensating for a fuel injection quantity using an oxygen sensor includes a storage 10, an information collector 20, an oxygen sensor 30, a high pass filter (HPF) 40, and a controller 50.

With respect to each of the aforementioned elements, first, the storage 10 may store a table in which reference values corresponding to the output and revolution per minute (RPM) of an engine and the speed of a vehicle are recorded. In other words, reference values that vary depending on conditions of the engine may be recorded in the table.

Here, the reference value refers to a value serving as a reference of dividing the intensity of a signal that is obtained by high-pass filtering an output voltage of the oxygen sensor 30 into a plus region and a minus region.

Next, the information collector 20 may collect the output and RPM of the engine, and the speed of the vehicle. The information collector 20 may be interlocked with an engine control unit (ECU) to collect the output and RPM of the engine, and may be interlocked with a cluster to collect the speed of the vehicle. It may collect all of the output and RPM of the engine, and the speed of the vehicle through a vehicle network.

Here, the vehicle network includes at least one of Controller Area Network (CAN), Local Interconnect Network (LIN), FlexRay, and Media Oriented Systems Transport (MOST).

The oxygen sensor 30 may measure the concentration of oxygen in exhaust gases during an exhaust stroke of each cylinder. Here, the oxygen sensor 30 may be any one of two oxygen sensors (a rear oxygen sensor and a front oxygen sensor) mounted in an exhaust manifold of the vehicle.

The output of the oxygen sensor 30 may be represented by voltage. As the voltage is increased, the concentration of oxygen in the exhaust gas is low. As the voltage is lowered, the concentration of oxygen in the exhaust gas is high.

Figure 2:
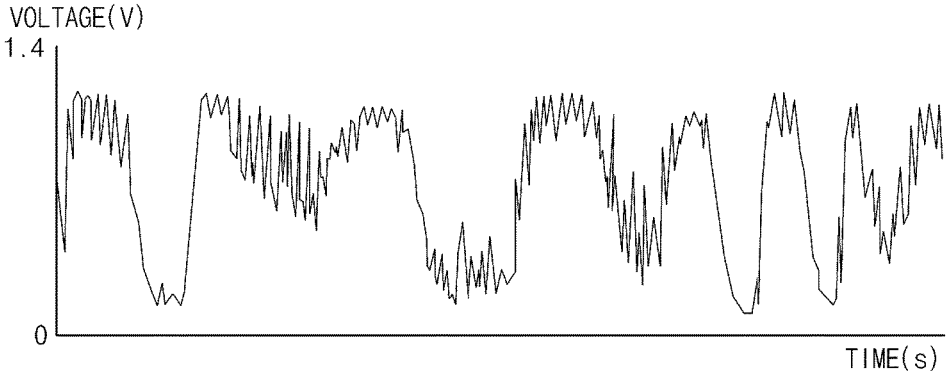
FIG. 2 is a graph illustrating an output voltage of an oxygen sensor, according to an exemplary form of the present disclosure.

For example, the output voltage of the oxygen sensor 30 is illustrated in FIG. 2. In FIG. 2, a vertical axis represents "voltage (V)", and a horizontal axis represents "time (5)".

For example, the oxygen sensor may be divided into a light and shade cell type and a magnetic type. The cell type oxygen sensor may include a solid electrolyte cell type oxygen sensor using stabilized zirconia and a wet cell type oxygen sensor using an electrolyte.

The solid electrolyte cell type oxygen sensor may have a long lifetime and be able to accurately measure the concentration of oxygen in the exhaust gas. Since it is desired to use this sensor by controlling the sensor temperature in a range of 500-800° C., it may be mainly used for the analysis of oxygen concentration in the exhaust gas or the combustion control of automobile engines, or in other analytical instruments.

The wet cell type oxygen sensor may measure a reduction current of oxygen dissolved in a cell by diffusion of the sample gas through a diaphragm. Since it operates at room temperature and is able to detect oxygen of several ppm to thousands of ppm, it may be mainly used in portable oxygen meters.

The magnetic type oxygen sensor may use a principle in which oxygen, unlike most gases, has paramagnetic properties. The magnetic type oxygen sensor may have two resistors in a wheatstone bridge, which are formed of platinum (Pt) temperature measuring resistors, place one of the temperature measuring resistors in a magnetic field to cause airflow due to the paramagnetism of oxygen, and use changes in temperature of the temperature measuring resistor. Since it has good reproducibility, it may be mainly used in industrial process measuring instruments.

If the oxygen sensor is able to measure the oxygen concentration in the exhaust gas, it may be applied to forms of the present disclosure regardless of types.

The HPF 40 that blocks a signal of low frequency and only allows a signal of high frequency to pass therethrough may filter the output voltage of the oxygen sensor 30. For example, the high-pass filtered signal is illustrated in FIG. 3.

Figure 3:
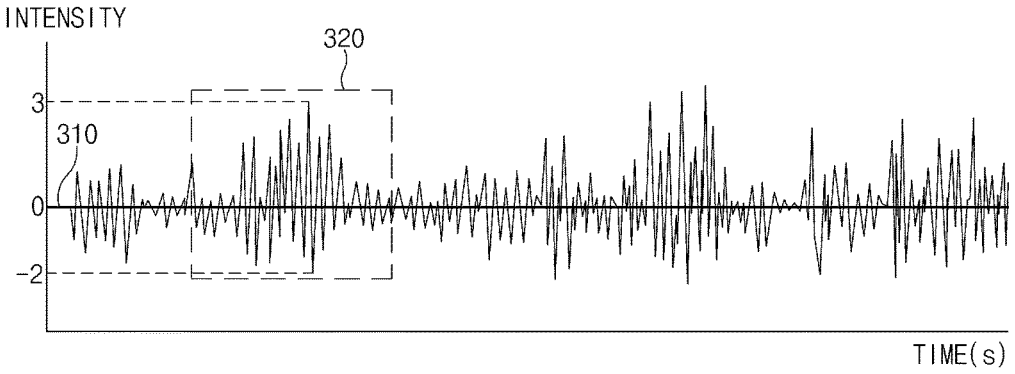
FIG. 3 is a graph illustrating the results obtained by high-pass filtering an output voltage of an oxygen sensor, according to an exemplary form of the present disclosure.

In FIG. 3, a vertical axis represents the intensity of a signal obtained by high-pass filtering the output voltage of the oxygen sensor 30, and a horizontal axis represents time (s), and "310" represents a reference value (reference line) determined by the controller 50. Here, when the reference line is moved upwardly from a current point, the intensity of the signal located in the plus region may be decreased, and when the reference line is moved downwardly, the intensity of the signal located in the plus region may be increased.

For example, when the reference value is 0, the intensity of the signal in the plus region (an upper region above the reference line) is +3 at a first point and the intensity of the signal in the minus region (a lower region below the reference line) is −2 at a second point, and when the reference value is increased from 0 to 1, the value at the first point in the plus region becomes +2 and the value at the second point in the minus region becomes −3. Here, the values at the first and second points may be detected at the same point in time.

On the contrary, when the reference value is decreased from 0 to −1, the value at the first point in the plus region becomes +4 and the value at the second point in the minus region becomes −1.

The controller 50 generally controls the aforementioned respective elements to perform the functions thereof normally.

The controller 50 may detect a reference value corresponding to the output and RPM of the engine and the speed of the vehicle collected by the information collector 20, on the basis of the table in which the reference values corresponding to the output and RPM of the engine and the speed of the vehicle are recorded. If there is no table, the controller 50 may generate a reference value corresponding to the output and RPM of the engine and the speed of the vehicle collected by the information collector 20, on the basis of a reference value detection algorithm.

In addition, the controller 50 may be interlocked with the ECU to recognize four stroke cycles (intake, compression, explosion, and exhaust) of the engine, activate the oxygen sensor 30 during the exhaust stroke based thereon, and control the oxygen sensor 30 to transmit the output voltage of the oxygen sensor 30 to the HPF 40 during the exhaust stroke.

In addition, the controller 50 may control the HPF 40 to high-pass filter the voltage output from the oxygen sensor 30 during the exhaust stroke.

In addition, the controller 50 may apply the detected reference value to the signal that is high-pass filtered by the HPF 40, divide the intensity of the high-pass filtered signal into the plus region and the minus region, and detect the intensity of the high-pass filtered signal per predetermined unit time.

Figure 4:
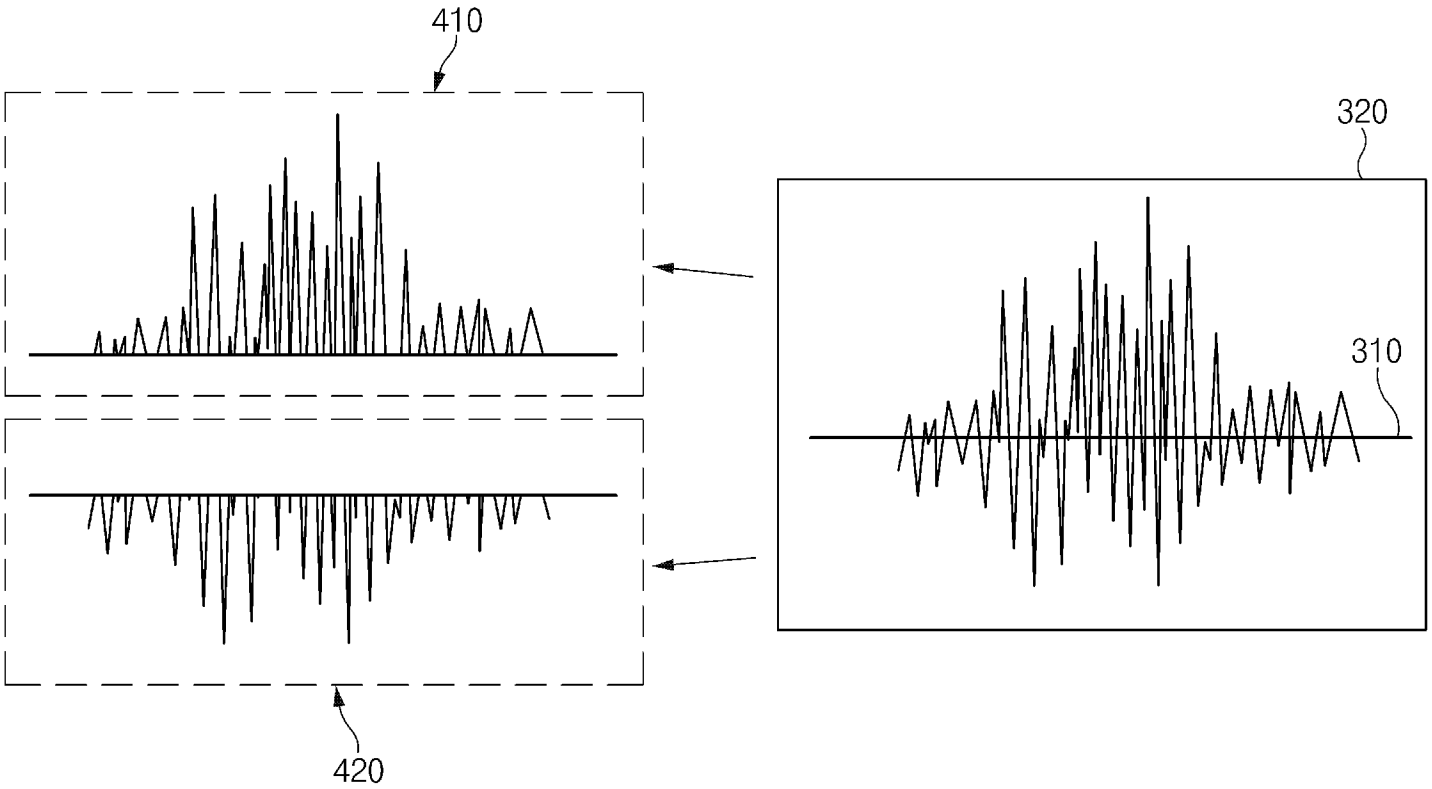
FIG. 4 illustrates a result of dividing a high-pass filtered signal into a plus region and a minus region based on a reference value, according to an exemplary form of the present disclosure.

For example, the signal high-pass filtered by the HPF 40 is illustrated in FIG. 3, and a portion 320 of the high-pass filtered signal in FIG. 3 is enlarged in FIG. 4.

FIG. 4 illustrates a result of dividing the high-pass filtered signal into a plus region 410 and a minus region 420 based on the reference value 310. Here, an index indicating the intensity of the high-pass filtered signal may change according to how the reference value is set.

For example, an index in the plus region may be indicated by $P_{term}(t)$, $P_{term}(t-1)$, or the like, and an index in the minus region may be indicated by $N_{term}(t)$, $N_{term}(t-1)$, or the like. Here, t represents time (point in time).

In addition, the controller 50 may calculate an offset for compensating for a fuel injection quantity based on an index in the plus region and an index in the minus region at the same point in time.

Here, the controller 50 may calculate the sum of an index ($P_{term}(t)$) at a current point in time and an index ($P_{term}(t-1)$) at a previous point in time in the plus region as a final index ($P_{term}$) in the plus region, and calculate the sum of an index ($N_{term}(t)$) at a current point in time and an index ($N_{term}(t-1)$) at a previous point in time in the minus region as a final index ($N_{term}$) in the minus region. In other words, a representative value in the plus region may be calculated by adding the intensity of the signal at the current point in time and the intensity of the signal at the previous point in time in the plus region, and a representative value in the minus region may be calculated by adding the intensity of the signal at the current point in time and the intensity of the signal at the previous point in time in the minus region.

Here, the number of indices to be added to calculate the final index in each region does not affect the present inventive concept. In other words, the process of calculating the final index by adding two indices is exemplified in the form, but a single index may be set to be a final index or three, four, ten, or one hundred indices may be set.

Meanwhile, the controller 50 may calculate an offset for compensating for a fuel injection quantity by adding the final index ($P_{term}$) calculated in the plus region and the final index ($N_{term}$) calculated in the minus region. Here, the offset (k) may satisfy $-1<k<1$.

In addition, the controller 50 may calculate a compensating fuel injection quantity by multiplying a reference fuel injection quantity (B) by the calculated offset (k). The calculated compensating fuel injection quantity may be added to the reference fuel injection quantity (B) to calculate a final fuel injection quantity (A). This will be expressed by the following equation 1:

$$A=B+(k\times B) \quad \text{Equation 1}$$

Here, the reference fuel injection quantity (B) may be determined on the basis of the output of the engine, the oxygen concentration, the temperature of a coolant, the presence or absence of a ramp, and the like. The present disclosure relates to a technology for compensating for the reference fuel injection quantity that is determined by a variety of techniques. Here, the compensating process includes the concept of increasing the reference fuel injection quantity as well as reducing the reference fuel injection quantity.

Alternatively, the functions of the controller 50 defined in the forms of the present disclosure may be added to the functions of the ECU.

Figure 5:
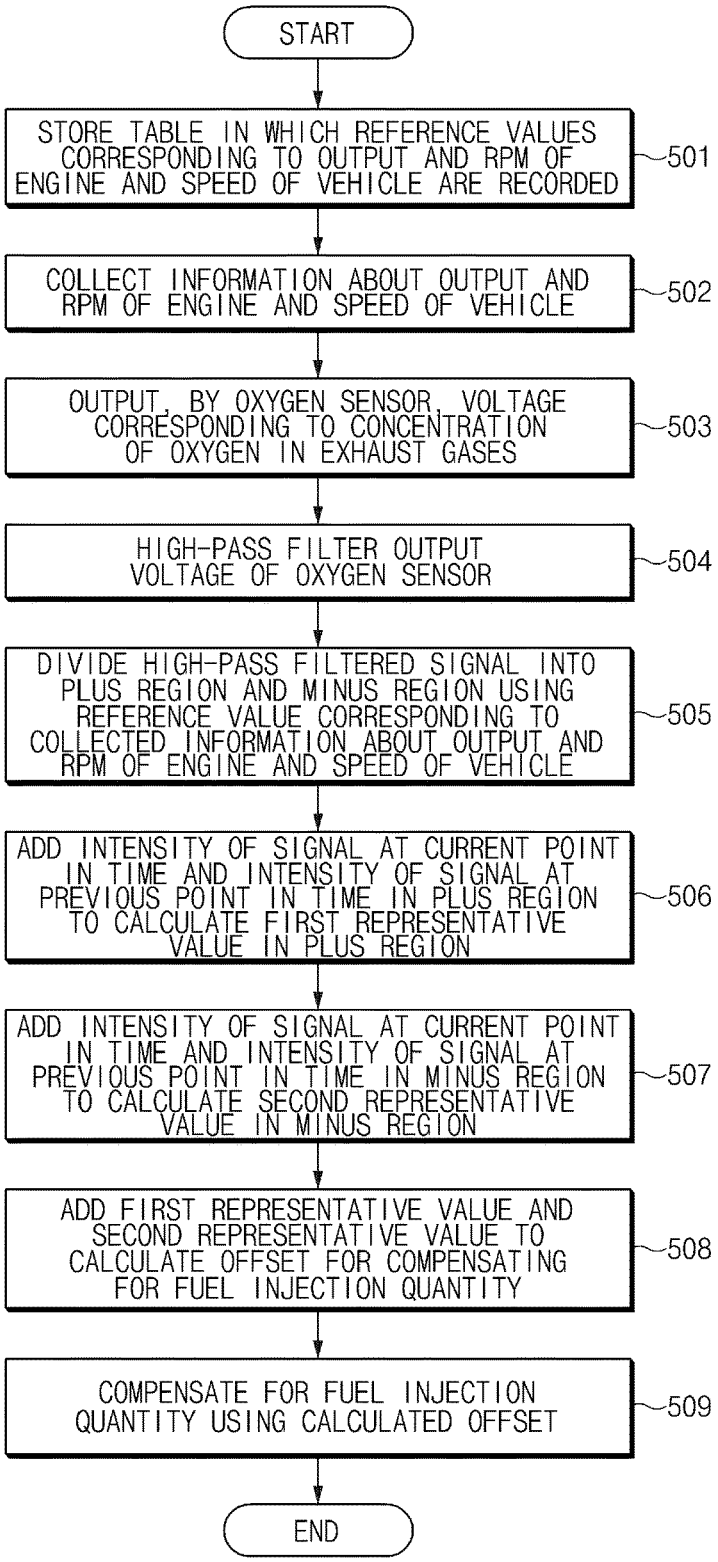
FIG. 5 illustrates a flowchart of a method for compensating for a fuel injection quantity in an engine of a vehicle, according to an exemplary form of the present disclosure.

FIG. 5 illustrates a flowchart of a method for compensating for a fuel injection quantity in an engine of a vehicle, according to an exemplary form of the present disclosure.

First of all, the storage 10 may store a table in which reference values corresponding to the output and RPM of the engine and the speed of the vehicle are recorded in operation 501.

Next, the information collector 20 may collect the output and RPM of the engine and the speed of the vehicle in operation 502.

Thereafter, the oxygen sensor 30 may output a voltage corresponding to the concentration of oxygen in exhaust gases in operation 503.

Then, the HPF 40 may high-pass filter the output voltage of the oxygen sensor 30 in operation 504.

After the controller 50 detects a reference value corresponding to the output and RPM of the engine and the speed of the vehicle collected by the information collector 20 from the table, it may apply the detected value to a signal having passed through the HPF 40 and divide the signal into a plus region and a minus region in operation 505. In other words, the controller 50 may divide the signal filtered by the HPF 40 into the plus region and the minus region using the reference value.

Then, the controller 50 may add an intensity of the signal at a current point in time and an intensity of the signal at a previous point in time in the plus region to calculate a first representative value in the plus region in operation 506.

Then, the controller 50 may add an intensity of the signal at the current point in time and an intensity of the signal at the previous point in time in the minus region to calculate a second representative value in the minus region in operation 507.

Thereafter, the controller 50 may add the first representative value and the second representative value to calculate an offset for compensating for a fuel injection quantity in operation 508.

Then, the controller 50 may compensate for a fuel injection quantity using the calculated offset in operation 509. In other words, a compensating fuel injection quantity may be calculated by multiplying a reference fuel injection quantity (B) by the calculated offset (k). The calculated compensating fuel injection quantity may be added to the reference fuel injection quantity (B) to calculate a final fuel injection quantity (A).

The process of compensating for a fuel injection quantity may be performed during every exhaust stroke in each cylinder, thereby reducing a torque deviation between individual cylinders.

In the above-described forms of the present disclosure, by measuring the output voltage of the oxygen sensor mounded in the exhaust manifold of the vehicle during the exhaust stroke of each individual cylinder and compensating for the fuel injection quantity in each individual cylinder of the engine on the basis of the result obtained by high-pass filtering the measured output voltage, a torque deviation between individual cylinders of the engine may be reduced.

In addition, by reducing the torque deviation between the cylinders of the engine, the fuel efficiency of the vehicle may be improved.

Furthermore, by reducing the torque deviation between the cylinders of the engine, the quantity of exhaust gases may be reduced.

In addition, by reducing the torque deviation between the cylinders of the engine, the durability of the engine may be improved.

Hereinabove, although the present disclosure has been described with reference to exemplary forms and the accompanying drawings, the present disclosure is not limited thereto, but may be variously modified and altered by those skilled in the art to which the present disclosure pertains without departing from the spirit and scope of the present disclosure.

What is claimed is:

1. An apparatus for compensating for a fuel injection quantity in an engine of a vehicle, the apparatus comprising:

an information collector configured to collect status information of the vehicle;

an oxygen sensor configured to output a voltage corresponding to a concentration of oxygen in exhaust gases;

a high pass filter (HPF) configured to filter the output voltage of the oxygen sensor; and a controller configured to generate a reference value based on the status information of the vehicle, obtain an offset using the reference value and a signal obtained by the high-pass filtered output voltage, and compensate for a fuel injection quantity in each individual cylinder of the engine based on the offset.

2. The apparatus according to claim 1, wherein the status information includes at least one of output of the engine, revolution per minute (RPM) of the engine, or a speed of the vehicle.

3. The apparatus according to claim 2, wherein the reference value corresponds to the output of the engine, the RPM of the engine, or the speed of the vehicle collected by the information collector, and wherein the controller is configured to divide the signal of the high-pass filtered output voltage into a plus region and a minus region based on the reference value, and the fuel injection quantity in each individual cylinder is compensated based on intensities of a signal detected in at least one of the plus region or the minus region.

4. The apparatus according to claim 3, wherein the controller is configured to add an intensity of a signal at a current point in time and an intensity of a signal at a previous point in time in the plus region and configured to calculate a first representative value in the plus region, and wherein the controller is configured to add an intensity of the signal at the current point in time and an intensity of the signal at the previous point in time in the minus region and configured to calculate a second representative value in the minus region, add the first representative value and the second representative value, and to calculate the offset to compensate for the fuel injection quantity.

5. The apparatus according to claim 4, wherein the controller is configured to multiply a reference fuel injection quantity by the calculated offset and calculate a compensating fuel injection quantity.

6. The apparatus according to claim 5, wherein the controller is configured to add the compensating fuel injection quantity to the reference fuel injection quantity and calculate a final fuel injection quantity.

7. The apparatus according to claim 1, wherein the controller is an engine control unit.

8. The apparatus according to claim 1, wherein the information collector is configured to collect the output and RPM of the engine, and a speed of the vehicle through a vehicle network.

9. The apparatus according to claim 8, wherein the vehicle network includes at least one of a Controller Area Network (CAN), a Local Interconnect Network (LIN), a FlexRay, or a Media Oriented Systems Transport (MOST).

10. A method for compensating for a fuel injection quantity in an engine of a vehicle, the method comprising the steps of:

collecting, by an information collector, status information of the vehicle;

outputting, by an oxygen sensor, a voltage corresponding to a concentration of oxygen in exhaust gases;

filtering, by a high pass filter (HPF), the output voltage of the oxygen sensor; and generating, by a controller, a reference value based on the status information of the vehicle, obtaining an offset using the reference value and a signal obtained by the high-pass filtered output voltage, and compensating for a fuel injection quantity in each individual cylinder of the engine of the vehicle based on the offset.

11. The method according to claim 10, wherein the status information includes at least one of output of the engine, revolution per minute (RPM) of the engine, or a speed of the vehicle.

12. The method according to claim 11, wherein the step of compensating for the fuel injection quantity comprises:

generating the reference value corresponding to the output of the engine, the RPM of the engine, or the speed of the vehicle;

dividing the signal of the high-pass filtered output voltage into a plus region and a minus region based on the reference value;

adding an intensity of a signal at a current point in time and an intensity of a signal at a previous point in time in the plus region to calculate a first representative value in the plus region;

adding an intensity of the signal at the current point in time and an intensity of the signal at the previous point in time in the minus region to calculate a second representative value in the minus region; and adding the first representative value and the second representative value to calculate the offset for compensating for the fuel injection quantity.

13. The method according to claim 12, further comprising multiplying a reference fuel injection quantity by the calculated offset to calculate a compensating fuel injection quantity.

14. The method according to claim 13, further comprising adding the compensating fuel injection quantity to the reference fuel injection quantity to calculate a final fuel injection quantity.

15. The method according to claim 10, wherein the step of collecting the status information is performed by collecting output and RPM of the engine, and a speed of the vehicle through a vehicle network.

16. The method according to claim 15, wherein the vehicle network includes at least one of a Controller Area Network (CAN), a Local Interconnect Network (LIN), a FlexRay, or a Media Oriented Systems Transport (MOST).

17. A method for compensating for a fuel injection quantity in an engine of a vehicle, the method comprising the steps of:

storing, by a storage, a table including reference values corresponding to output of the engine, revolution per minute (RPM) of the engine, and a speed of the vehicle, respectively;

collecting, by an information collector, information of the output of the engine, the RPM of the engine, and the speed of the vehicle;

outputting, by an oxygen sensor, a voltage corresponding to a concentration of oxygen in exhaust gases;

filtering, by a high pass filter (HPF), the output voltage of the oxygen sensor;

detecting, by a controller, a reference value corresponding to the collected information of at least one of the output of the engine, the RPM of the engine, or the speed of the vehicle, from the table;

obtaining, by the controller, an offset based on the reference value and a signal of the high-pass filtered output voltage, and compensating for a fuel injection quantity in each individual cylinder of the engine based on the offset.

18. The method according to claim 17, wherein the step of compensating for the fuel injection quantity comprises:

detecting the reference value corresponding to the collected information of the output and RPM of the engine and the speed of the vehicle from the table;

dividing a signal of the high-pass filtered output voltage into a plus region and a minus region based on the reference value;

adding an intensity of a signal at a current point in time and an intensity of a signal at a previous point in time in the plus region to calculate a first representative value in the plus region;

adding an intensity of the signal at the current point in time and an intensity of the signal at the previous point in time in the minus region to calculate a second representative value in the minus region; and adding the first representative value and the second representative value to calculate the offset to compensate for the fuel injection quantity.

19. The method according to claim 18, further comprising multiplying a reference fuel injection quantity by the calculated offset to calculate a compensating fuel injection quantity.

20. The method according to claim 19, further comprising adding the compensating fuel injection quantity to the reference fuel injection quantity to calculate a final fuel injection quantity.

* * * * *